United States Patent [19]

Smith

[11] 4,416,026

[45] Nov. 22, 1983

[54] MULTI-PURPOSE MECHANIC'S GLOVE

[76] Inventor: Michael C. Smith, 10931 Mills Choice Rd., Gaithersburg, Md. 20760

[21] Appl. No.: 323,893

[22] Filed: Nov. 23, 1981

[51] Int. Cl.[3] ..... A41D 19/00

[52] U.S. Cl. ..... 2/161 R

[58] Field of Search ..... 2/161 R, 158, 159, 163, 2/170

[56] References Cited

U.S. PATENT DOCUMENTS

| | | | |
|---|---|---|---|
| 482,647 | 9/1892 | Obear . | |
| 1,664,542 | 4/1928 | Douglass . | |
| 1,796,319 | 3/1931 | Burden . | |
| 2,242,318 | 2/1940 | Mosler . | |
| 2,333,594 | 11/1943 | Smither . | |
| 2,559,783 | 7/1951 | Patterson . | |
| 2,609,543 | 9/1952 | Farrell . | |
| 3,258,782 | 7/1966 | Turnidge et al. . | |
| 3,363,265 | 1/1968 | Dunmire . | |
| 4,021,640 | 5/1977 | Gross et al. | 2/161 R |
| 4,094,014 | 6/1978 | Schroeder | 2/161 R |
| 4,195,405 | 4/1980 | Monk . | |

*Primary Examiner*—Doris L. Troutman

*Attorney, Agent, or Firm*—Browdy and Neimark

[57] ABSTRACT

An improved mechanic's glove having a plurality of openings on various of the finger stalls, and in the palm, to permit feel of the tools or other work being handled while at the same time providing substantial protection. The improved glove also includes padding on the back side and some of the palm side of the hand, together with a removable gauntlet.

10 Claims, 4 Drawing Figures

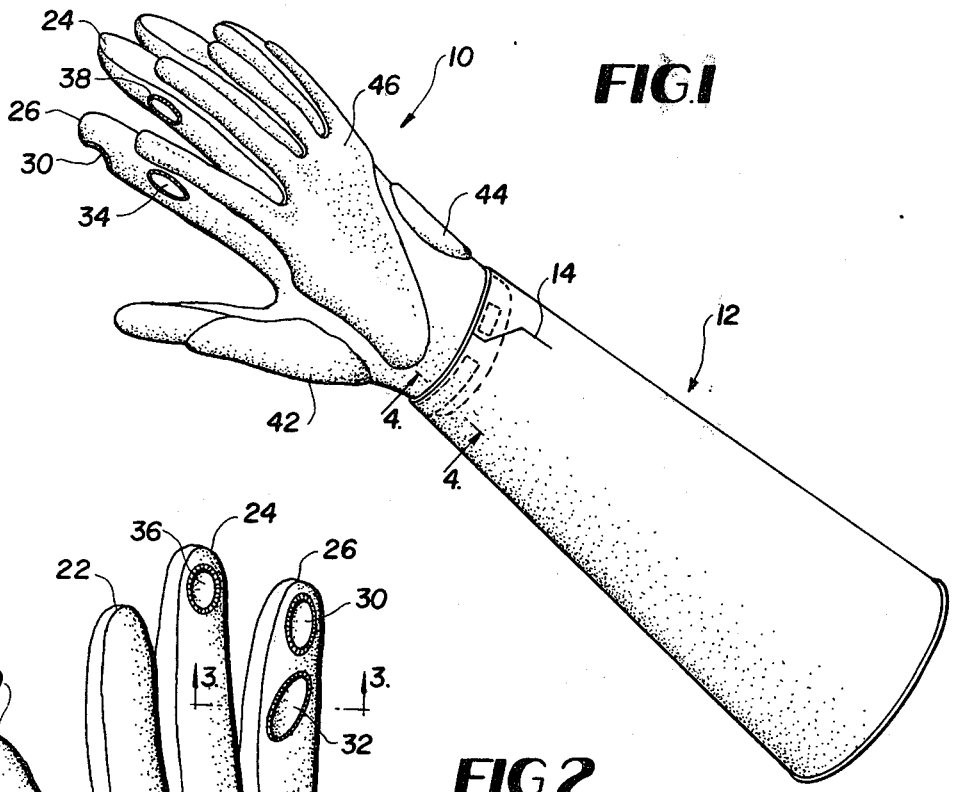
FIG. 1
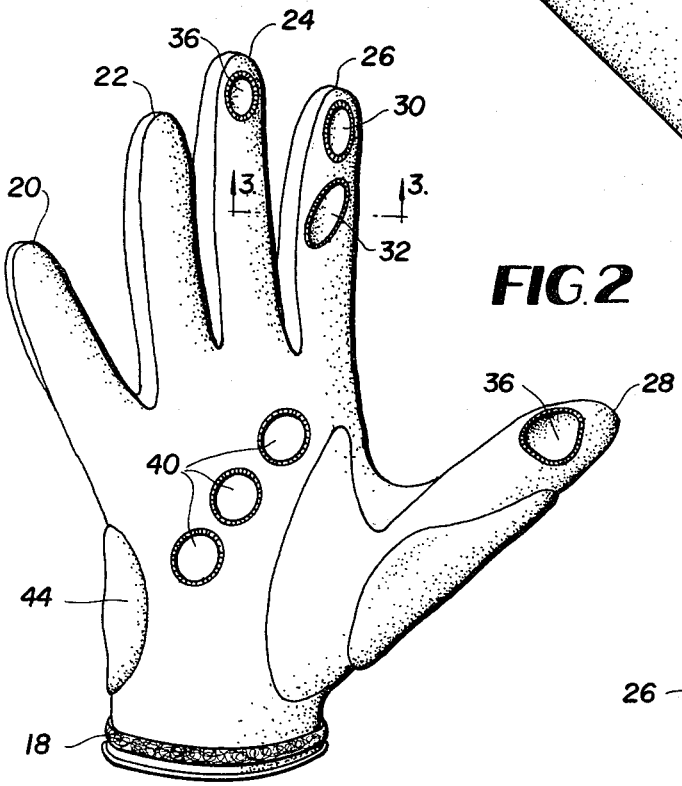
FIG. 2
FIG. 3
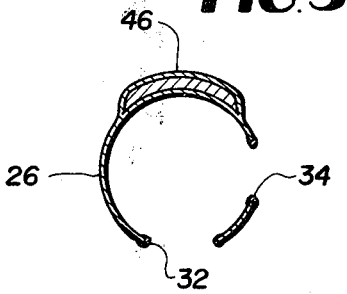
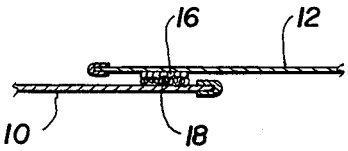
FIG. 4

MULTI-PURPOSE MECHANIC'S GLOVE

This invention relates to gloves, and particularly to improved gloves for mechanics or other workmen who have to manipulate tools, nuts and bolts and the like.

Due to the mass production techniques, and the need to work with rough edges, many different components, in many different fields, mechanics and workmen of all sorts have many problems having to do with injuries to the hands such as cuts, scrapes, lacerations, abrasions and the like. Gloves of various sorts have been provided, but these have numerous problems.

Most of these gloves have not been well received, and in face have been little used for a number of reasons. First of all, such gloves and the like are often expensive, which expense in many cases must be borne by the workman himself. Further, such gloves often have a poor fit resulting in discomfort in use.

Perhaps most importantly however is that when the workman puts anything on his hands he must sacrifice a certain amount of the "feel" of the work. This point is perhaps best illustrated in regard to welders. Because they work with such extremely dangerous material, hot molten metal which is often flung about the work space, they work with extremely heavy gloves. A welder has very little feel for his work, but he works only with the welding rods, heavy chisels, and the like and thus the extremely heavy thick full palm and back side coverings with guantlets of the gloves worn by welders are satisfactory for their use. At the other extreme, a bank teller for example when counting large amounts of money, which money has sharp edges and can cut the fingers, is often satisfied with only little partial finger stalls covering only the outermost one or two joints of one or two fingers to protect his hands from cuts by the money.

In between these extremes is the full gamut of the working world of mechanics and workmen, such as appliance repairmen, assemblers of medium weight equipment, machinists, repairment of other sorts of equipment, small engine servicemen, and the like. All of these people need to have a balance of protection in the one case, and yet an adequate feel and control of the tools and the work with which they deal.

The present invention is directed to that wide gamut between the extremes of the full heavy protection and the very light or no protection type workmen.

Thus the invention provides a glove which is padded on the back side to protect the hand from injuries there, which is more lightly protected on the palm side, and, which, most importantly, is provided with the plurality of cutouts in critical places on the glove to permit the corresponding critical areas of the hand to perform numerous jobs, all of a multi-purpose nature. That is, the invention is not directed to any specific kind of work situation, but to the wide gamut between the ones where full protection is needed as in welding or concrete work or the like, and the other extreme where little or no protection is needed as in handling paper only or very light assembly work. This is to be contrasted with the art heretofore where special gloves have been provided for assembly line workers doing one specific job, or in recreational areas such as gloves designed specifically for golfers, tennis players, archers, or in other sports.

Another feature of the invention is the provision of a removable gauntlet which can be attached by the workman when he needs to put his hand in an area where his arm may be injured, and which is easily removed for other uses where there is no such danger.

The above and other advantages of the invention will be pointed out or will become evident in the following detailed description and claims, and in the accompanying drawing also forming a part of the disclosure, in which:

FIG. 1, is a perspective view of a glove embodying the invention showing the gauntlet attached looking generally from the back side of the glove:

FIG. 2, is a palm side view of the glove with the gauntlet removed, and

FIGS. 3 and 4, are partial cross-sectional views taken on lines 3—3 and 4—4 of FIGS. 2 and 1, respectively.

Referring now in detail to the drawings, there is shown a multi-purpose mechanic's or wokman's glove 10 with a removable guantlet 12.

The guantlet 12 is a sheath of suitable material, having a slit 14 at its upper end, and provided with securing means 16 and 18 fixed respectively to the glove 12 and 10 (FIG. 4) to removably attach the guantlet to the glove. The ring of securing means 18 is shown at the wrist portion of the glove in FIG. 2. The securing means 16 and 18 may preferably comprise a pair of strips of removably attachable material sold under the trademark "Velcro". Alternatively, for other uses, other securing means, such as snaps, slide actuated fasteners, or the like could also be used.

To add or remove the guantlet 12 from the glove, the guantlet is opened at the slit 14, and the attaching means 16 and 18 are brought into contact in such a way at to automatically close the slit 14. As is clear to those skilled in the art and users of the glove, the guantlet can be provided or not provided as necessary by the demands of a particular job to which the multi-purpose glove of the invention is taken by a user or a workman.

Glove 10, see FIGS. 1 and 2, comprises a usual arrangement of four finger stalls 20, 22, 24, 26 and a thumb stall 28. The third finger and little finger stalls 20 and 22 are not provided with any openings, since these two fingers are relatively little used by the mechanics and workmen which it is anticipated will be the users of the invention.

The thumb stall 28, the index finger stall 26 and the middle finger stall 24, as well as the palm of the hand are provided with a plurality of openings, each one of which is specifically positioned and sized for a particular purpose. It is to be noted that the total area of the hand exposed, that is the amount of skin shown or exposed through the total area of all of these openings, is estimated to be approximately 7% of the total area of the hand. Put another way, the glove of the invention protects 93% of the hand, while at the same time providing substantially all of the feel and control the workman would have without a glove.

The sizes and positions of the holes have been determined on an empirical, based on usage, basis. The invention glove is designed to provide substantially full feel and control for five different general types of operations, thus giving it the advantages of its multi-purpose appeal to mechanics and workmen in many different fields.

The index finger, the most important finger to workmen of all sorts, is provided with three openings, an opening 30 at the tip of generally round configuration; and an opening 32 on the palm side and slightly down the finger from the opening 30. This opening 32 is of generally oval configuration and is angled across the axis of the finger. An opening 34, see FIG. 1, is provided on the side of the index finger. The opening 34 is used to angle or position a tool or part being manipulated. The two openings 30 and 32 on the palm side of the index finger stall cooperate with an opening 36 on the ball of the thumb. The opening 30 cooperates with the thumb for fine control, as in a holding a pencil type motion which is needed in many different applications, as in holding a nut to position it on a screw, and the like. The opening 32 can be used with the ball opening 36 and the thumb, with the side of the thumb, or with tools, and is particularly useful in doing rolling in or rolling out motions, as when tightening a nut on a bolt, or the like. In addition, the opening 30 at the tip of the index finger aids in "locating the target"; that is, to insert this opening in a closed or dark space to find something which needs to be worked upon.

The middle finger stall 34 is provided with an opening 36 at the tip analogous in configuration and function to the opening 30 at the tip of the index finger stall 26. Similarly, the middle finger stall 24 is provided with an opening on the side 38 analogous to the opening 34 on the index finger stall 26. The middle finger often does some of the same kind of work as does the index finger, i.e. it can be used to tighten or loosen nuts, position small parts, and the like. Further, the index finger is often used to guide and position tools which are held in the hand and by the thumb and other fingers. Accordingly, the exposed areas are provided on the middle finger to do the same kinds of work as are done by the index finger, and to serve these guiding functions.

The palm of the glove 10 is provided with three openings 40 which are angled across the palm in a radial line, more or less, with respect to the line which would be described by the thumb motion across the palm. These openings are provided to give the workman a sense of control and allow him to feel or better grip tools, suc as a screw driver or pair of pliers or the like. A plurality of openings are provided rather than a single larger opening in order not to unduly weaken the glove itself, in the embodiment shown.

Alternatively, a single larger opening could also be provided where the material used lends itself to having a relatively larger opening provided without unduly or adversely effecting the performance of the glove in use.

As to materials, good qualities of leather, heat resistent materials, coated fabrics, combinations of these materials, and other fabrics could be used to fabricate the invention glove. This will depend on cost factors, durability expected, particular applications to which the invention design could be applied, and the like, all as will be clear to those skilled in the glove arts.

Means are provided to protect the back and sides of the hand, while at the same time minimally interfering with the flexibility of the glove as is required in use. To this end, three areas of padding are provided, a thumb area 42, a side area 44, and a main back of the hand area 46. The large area 46 on the back of the hand extends up the finger stalls, and stops short of the outermost joint of each finger, so as to not interfere with mobility at that critical area of the hand. It is also to be noted, as shown in FIG. 1, that these three areas are segregated from each other by relatively small areas which are not padded, thus minimally interfering with the flexibility of the thumb with respect to the rest of the hand, and with the motion of the palm of the hand as protected by the side protective area 44. The manner of fabricating these padded areas is shown in FIG. 3, a cross section taken through the index finger which also incidentally shows the relationship of the control areas 32 and 34 on the palm and side of the index finger stall. The padding material can be any suitable substance, such as plastic foam, felt, leather, or other materials well known to glove makers.

The particular glove 10 shown in the drawings is intended to fit on the hand by elasticizing the wrist portion, which is not specifically shown in the drawings as it can be woven or otherwise built into the material of the glove. Other means, such as a split and Velcro type fasteners could be provided across the back of the hand, as is commonly used in golf and athletic gloves. Slide actuated fasteners, snaps, buttons and the like could also alternatively be used if a split glove rather than a form fitting slip-on glove were desired by any particular user or in any particular application.

Further in regard to materials, the guantlet especially is preferably made of heat resistant material, and possibly also of a heavier material since no particular feel or control is needed above the write. Certain plastics or composits including asbestos, are anticipated for use as the material of the guantlet.

While the invention has been described in detail above, it is to be understood that this detailed description is by way of example only, and the protection granted is to be limited only within the spirit of the invention and scope of the following claims.

I claim:

1. A multi-purpose mechanics glove adapted to cover substantially the entire hand from the wrist to the fingers comprising four finger stalls and a thumb stall, said glove being formed with a plurality of openings at selected locations to expose corresponding portions only of the hand of the mechanic wearing the glove, at least one opening of said plurality being formed in the palm of the hand to permit feel and control of tool handles and the like, an opening formed at the ball of the thumb for guiding and for cooperation with the user's index finger, at least two openings formed in the index finger stall, one at the ball of the index finger and a second at the palm side of the index finger stall, said second opening being of generally oval elongated shape to permit cooperation with the exposed area of the ball of the thumb in rolling in or rolling out motions of manipulation, said one opening at the ball of the index finger stall aiding in locating type uses of the index finger and permitting cooperation of the facing exposed portions of the balls of the index finger and the thumb in motions of fine manipulation, and the total area of the users hand exposed by the total of the areas of all of said plurality of openings comprising no more than 10% of the total area of said user's hand from the wrist to the finger tips.

2. The glove of claim 1, said index finger stall being formed with a third opening on the side thereof facing the thumb, said third opening being useful in manipulating the sides of tools, and for angling and controlling tools manipulated by the user of the glove.

3. The combination of claim 2, said middle finger stall being formed with an opening located at the ball of a finger inserted therein analogous to the corresponding opening in said index finger stall, and said middle finger stall being formed with a second opening on the side thereof closest to said thumb analogous to said third opening in said index finger stall.

4. The combination of claim 1, said palm of said glove being formed with three openings arranged generally in a line described generally by the curve which would be described by the tip of the thumb moved across the palm in use of the glove.

5. The combination of claim 1, and padding means on the back and sides of said glove to protect the hand of a user from injury coming from those directions, said padding means comprising additional layers of materials in said back and side portions.

6. The combination of claim 5, said padding means comprising three separate padded areas separated by small unpadded areas, whereby said separate padded areas permit unimpeded flexibility of the users hand, said padded areas comprising a first area on the outside of the thumb, a second area on the outside of the hand closely positioned to the wrist area, and a relatively large padded area over the bulk of the back of the hand extending up into the fingers and terminating short of the tips of the fingers.

7. The combination of claim 1, and gunatlet means cooperable with said glove, and means to removably attach and detach said guantlet means to said glove at the wrist area of said glove.

8. The combination of claim 7, said removable attaching and detaching means comprising VELCRO fasteners provided at the glove end of said guantlet and at the wrist end of said glove.

9. The combination of claim 7, said guantlet consisting of heat and abrasion resistant material thicker and less flexible than the material of which said glove is formed.

10. The combination of claim 1, said glove being formed primarily of leather, plastics, or heat resist relatively thin flexible materials, and the like.

* * * * *

UNITED STATES PATENT AND TRADEMARK OFFICE

CERTIFICATE OF CORRECTION

PATENT NO. : 4,416,026

DATED : Nov. 22, 1983

INVENTOR(S) : Michael C. Smith

It is certified that error appears in the above–identified patent and that said Letters Patent are hereby corrected as shown below:

On the title page

The following patents should be added to

[56] References Cited:

--USP 3,739,400 3/72 Colehower

USP 1,479,771 1/24 Campbell--

Signed and Sealed this

*Twenty-fourth* Day of *April 1984*

[SEAL]

*Attest:*

GERALD J. MOSSINGHOFF

*Attesting Officer*

*Commissioner of Patents and Trademarks*